US007506758B2

(12) United States Patent
Davis-Garrison

(10) Patent No.: US 7,506,758 B2
(45) Date of Patent: Mar. 24, 2009

(54) AUDIOVISUAL ACCESSORY ORGANIZING APPARATUS

(76) Inventor: Vanessa G. Davis-Garrison, 517 N. 38rd Ter., Kansas City, KS (US) 66112

( * ) Notice: Subject to any disclaimer, the term of this patent is extended or adjusted under 35 U.S.C. 154(b) by 509 days.

(21) Appl. No.: 11/159,014

(22) Filed: Jun. 22, 2005

(65) Prior Publication Data

US 2006/0290177 A1 Dec. 28, 2006

(51) Int. Cl.
*B65D 85/00* (2006.01)

(52) U.S. Cl. ..... 206/320; 206/564; 297/188.06

(58) Field of Classification Search ..... 206/198, 206/315, 320, 371, 424, 427, 428, 470, 553, 206/562, 563, 564, 565; 16/114.1; 297/188.06
See application file for complete search history.

(56) References Cited

U.S. PATENT DOCUMENTS

| | | | | | |
|---|---|---|---|---|---|
| 1,725,508 | A | | 8/1929 | Bell-Clifford | |
| 1,738,557 | A | * | 12/1929 | Beiling | 248/694 |
| 2,061,302 | A | * | 11/1936 | Egler | 297/188.18 |
| 2,380,215 | A | * | 7/1945 | Caldara | 368/291 |
| 2,804,902 | A | * | 9/1957 | Luther et al. | 206/316.2 |
| 2,822,968 | A | | 2/1958 | Jackson | |
| 2,953,288 | A | | 9/1960 | Peterson | |
| 3,042,467 | A | | 7/1962 | Germick | |
| 3,233,563 | A | | 2/1966 | Mauchline | |
| 3,268,133 | A | | 8/1966 | McAnallen | |
| 3,278,008 | A | | 10/1966 | Larkim | |
| 3,717,188 | A | * | 2/1973 | Green | 224/42.11 |
| 3,804,233 | A | | 4/1974 | Gregg, Jr. | |
| 4,128,170 | A | * | 12/1978 | Elliott | 206/315.11 |
| 4,300,709 | A | * | 11/1981 | Page, Jr. | 224/275 |
| 4,727,890 | A | * | 3/1988 | Vincent | 131/329 |
| D319,730 | S | * | 9/1991 | Steenson | D12/420 |
| 5,114,108 | A | * | 5/1992 | Olschansky | 248/311.2 |
| 5,246,151 | A | * | 9/1993 | Jabara | 224/544 |
| 5,294,026 | A | * | 3/1994 | McGirt | 224/549 |
| 5,503,297 | A | * | 4/1996 | Frankel | 220/751 |
| 5,516,191 | A | * | 5/1996 | McKee | 297/188.15 |
| 5,605,235 | A | | 2/1997 | Johnson | |
| 5,692,608 | A | | 12/1997 | Simien | |
| 5,806,101 | A | * | 9/1998 | Thurwanger et al. | 2/424 |
| 6,033,029 | A | * | 3/2000 | Henshall | 297/468 |
| 6,644,527 | B1 | * | 11/2003 | Karenga | 224/602 |
| D492,114 | S | | 6/2004 | Sulier | |
| 7,104,580 | B2 | * | 9/2006 | Clark et al. | 296/24.32 |
| 7,284,791 | B1 | * | 10/2007 | Wright | 297/188.18 |
| 2002/0018601 | A1 | | 2/2002 | Nelson | |

* cited by examiner

*Primary Examiner*—J. Gregory Pickett
*Assistant Examiner*—Ernesto A Grano
(74) *Attorney, Agent, or Firm*—Erickson, Kernell, Derusseau & Kleypas, LLC

(57) ABSTRACT

A configurable organizing apparatus in combination with occupancy equipment comprises a connecting structure having a weighted elongated connector complementing the occupancy equipment connected to a sectional storage unit having a base and plural vessel holding compartments which are adapted for receiving various containers. The sectional storage unit is secured to the occupancy equipment with the connecting structure and includes organizing features which organizes various accessories including plural audio visual aids. The base optionally includes a replaceable lid, which also presents a horizontal writing surface for use on the occupancy equipment.

4 Claims, 5 Drawing Sheets

AUDIOVISUAL ACCESSORY ORGANIZING APPARATUS

FIELD OF THE INVENTION

The present invention relates to an apparatus for organizing accessories for use in combination with an occupancy equipment device, more particularly for organizing accessories which enhance the audio visual experience including but not limited to audio-visual and food and beverage containers while using the occupancy equipment.

BACKGROUND OF THE INVENTION

Home entertainment centers with multiple audio-visual devices are becoming more common in many residential environments some of which have remote controllers for utilizing the equipment from a remote location like an occupancy equipment device. Because of the variable number of accessories which may be used to control these audio-visual equipment devices, if would be beneficial to have some method of organizing and storing these accessories.

Some audio-visual equipment plays music while other equipment displays movies for families to enjoy. The time a family spends listening to music or watching movies in their residential home theaters may include eating time or social time with friends and families. It would therefore be beneficial to have a method of holding or supporting refreshment containers for use while enjoying the audio-visual equipment.

In addition, time spent enjoying various audio-visual devices may include leisure time using occupancy equipment, equipment which may have various shapes and sizes based on the needs of various individuals or groups. While some commercially available equipment has built-in containers, these containers have disadvantages. It would therefore be beneficial to have an organizing apparatus in combination with occupancy equipment for organizing various containers and accessories including audio-visual accessories while using the occupancy equipment which does not permanently alter the occupancy equipment and can be easily removed or placed when needed.

SUMMARY OF THE INVENTION

In an embodiment of the present invention, the foregoing is addressed by providing an organizing apparatus in combination with an occupancy equipment device the organizing apparatus comprising a connecting structure complementing the occupancy equipment and a sectional storage unit with a base and a pair of vessel holding compartments adapted for receiving containers which optionally include resealable lids. The base has a receiving structure along with a front and a rear separated by a top portion adapted for receiving a replaceable lid. The receiving structure organizes the plural audio-visual aids while the sectional storage unit is secured to the occupancy equipment with the connecting structure.

DETAILED DESCRIPTION

Certain terminology will be used in the following description for convenience in reference only and will not be limiting. For example, up, down, front, back, right and left refer to the illustrated embodiment as oriented in the view being referred to. The words "upwardly" and "downwardly" refer to directions up or down and away from, respectively, the geometric center of the embodiment being described and designated parts thereof. Such terminology will include the words specifically mentioned, derivatives thereof and words of similar meaning.

Figure 1:
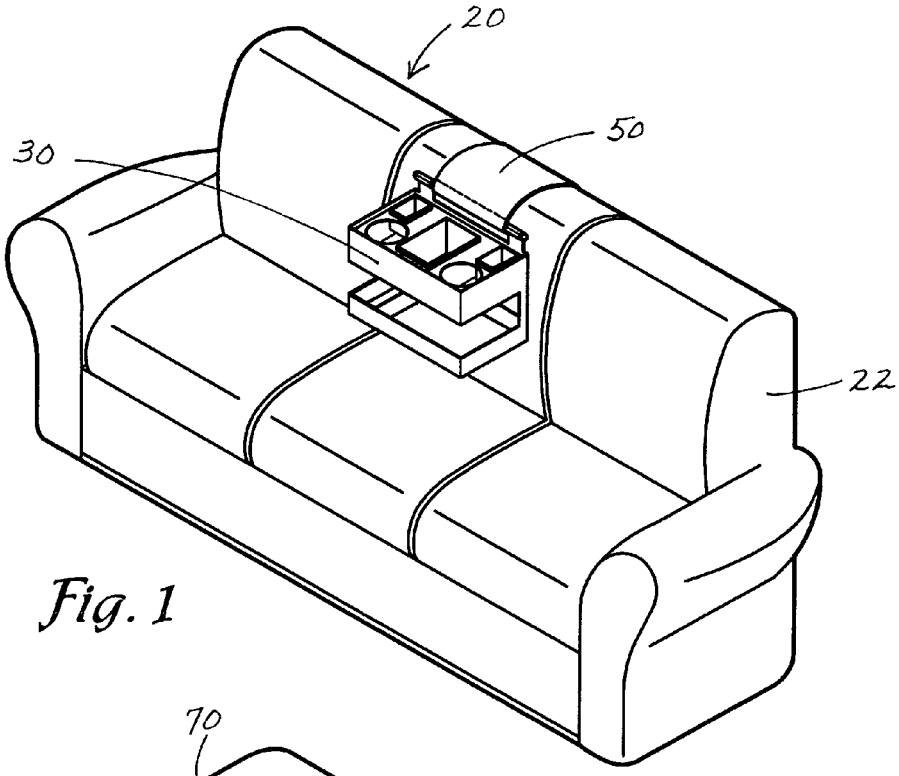
FIG. 1 is a front perspective view of an embodiment of the audio-visual organizing apparatus in combination with occupancy equipment.

Referring to FIG. 1, an audio-visual organizing apparatus in combination with occupancy equipment is generally indicated by reference numeral 20. Apparatus 20 is illustrated as overlying the occupancy equipment 22. The apparatus 20 includes a sectional storage unit 30 and a connecting structure 50 arranged, for example, near the back side of the occupancy equipment 22. In general, the sectional storage unit 30 is adapted for holding and organizing items which may be desired while using any nearby audio-visual equipment (not shown) for positioning near the occupancy equipment 22.

Figure 2:
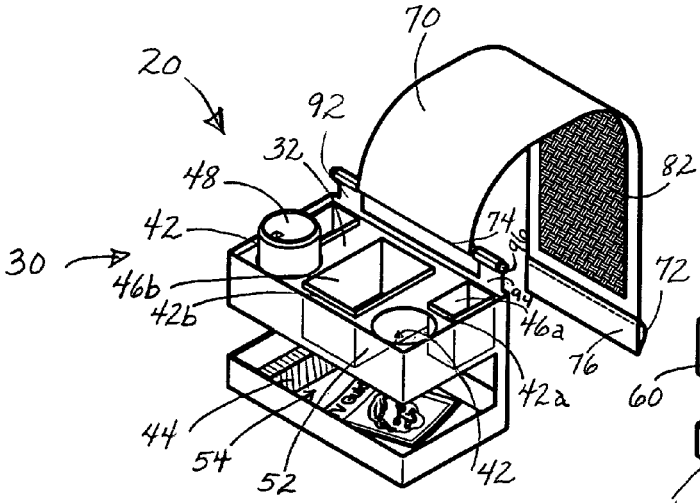
FIG. 2 is a rear perspective view of the embodiment shown in FIG. 1.

As illustrated in FIG. 2, the sectional storage unit 30 includes a base or top portion 32 with multiple vessel holding compartments 42*a-b* which are adapted, in general, to receive various containers such as accessory containers 44, food containers 46*a-b* and beverage containers 48. A first vessel holding compartment 42*a* is adapted for receiving a first container 46*a* and a second vessel holding compartment 42*b* is adapted for receiving a second container 46*b*.

Figure 3:
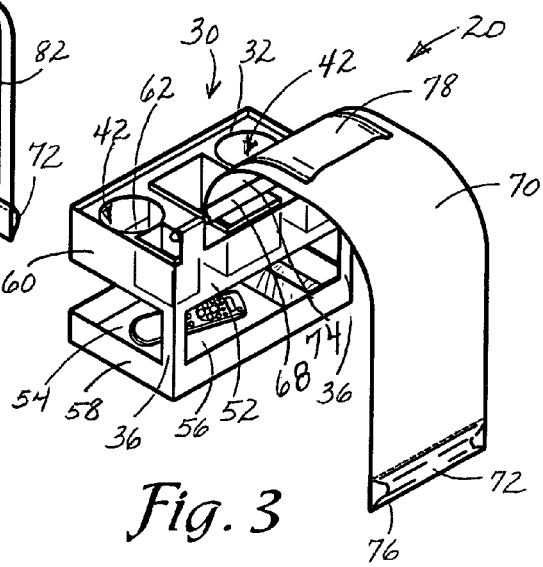
FIG. 3 is a rear perspective view of an alternative connecting structure configuration of the embodiment shown in FIG. 1.

Suitable materials for the sectional storage unit 30 include materials which would support the various accessories received by the organizing apparatus 20 and may include various materials including, but not limited to, rigid plastic, flexible plastic, silicon, metal or cardboard. In addition, the containers 46*a-b* and 48, are capable of holding consumable products and are preferably made from a washable material such as but not limited to plastic. The accessory container 44 may be used to contain a variety of personal accessory items such as but not limited to phones, video games, audio-visual remote controllers, books, magazines, seeing aids or playing cards, which may be positioned for use while using nearby audio visual equipment. The food containers 46*a-b* may be used with consumables such as dips, spreads, chips, snacks, servings of food or meals. The beverage container 48 may be cups, bottles or cans used for holding fluid items such as soda, water or other liquid refreshments. FIGS. 2 & 3 illustrate a centrally located vessel holding compartment 42*b* in receipt of the food container 46*b* being adapted for storing a larger portion of food such as potato chips. Additional vessel holding compartments 42*a-b* may be rectangular, circular or irregularly shaped for receiving a variety of accessory, food or beverage containers 44, 46*a-b,* 48.

The connecting structure 50 is illustrated in FIG. 2 as an elongated strap 70 with a proximate 74 and a distal 76 end separately located and a weighted member 72 associated with one of the strap ends 74, 76. In general, the elongated strap extends between the sectional storage unit 30 and the weighted member 72.

FIG. 2 illustrates the proximate end 74 of the elongated strap 70 extending from the sectional storage unit 30, the weighted member 72 being connectably located near the distal end 76. The sectional storage unit 30 includes a first and second base mounting arm 92, 94 separated from each other and extending outwardly from the unit 30. The first and second mounting arms 92, 94 are adapted to receive a rigid member 96 which extends therebetween. The proximate end 74 of the strap 70 includes a loop connector 68 extending from the strap proximate end 74 adapted to receive the rigid member 96 which may be mechanically fastened to the first and second mounting arms 92, 94. The loop connector 68 in receipt of the rigid member 96 pivotally connects the strap 70 to the sectional storage unit 30. The underside of the elongated strap 70 is illustrated with a frictional surface 82 connected to the elongated strap 70. The frictional surface 82 is designed to increase the frictional coefficient of the strap 70, for supporting the weight of the organized accessories stored within the sectional base unit 30 in a stationary and stable manner. The frictional surface 82 may be comprised of a frictional material having non-sliding features. The frictional surface 82 may optionally be compressible to help absorb the impact of the sectional storage unit 30, protecting the occupancy equipment 22 from any damage which may be caused from the weight of the sectional storage unit 30 with the various accessories.

The weighted member 72, being known in the art, may include heavy material with a greater specific gravity and weight in comparison to the volume of its material, located within the lining of the elongated strap 70 or in an exterior pocket located along the strap 70. The weighted member 72 may be a shaped metal material or a pliable aggregate mix, such as but not limited to sand, which is attached near the second end 76. The weighted member 72 is configured to balance the sectional storage unit 30 on the occupancy equipment 22 without overcoming the frictional coefficient of the elongated strap 70. The strap 70 may also include an accessory pocket 78, as shown in FIG. 3, located on the exterior surface of the strap 70 near the proximate end 74, the pocket 78 being adapted for storing various accessories such as but not limited to audio-visual accessories near the proximate end 74.

The sectional storage unit 30 is illustrated having a multi-tier configuration with an upper storage area 52 adapted for the base 32 and a lower storage area 54 in FIGS. 2 and 3, vertically arranged to allow for consolidation through stacking the various accessories. As seen in FIG. 3, the lower storage area 54 has a substantially planar bottom 56 with a lower peripheral sidewall 58 extending along the perimeter of bottom 56 which in combination, generally adapt the lower storage area 54 for holding larger sized accessories including audio-visual program guides, video or music media, paper, reading materials, remote controllers and other items which may not fit within the vessel holding compartments 42*a-b* illustrated on the upper storage area 52.

FIG. 2 illustrates an audio-visual schedule located on the lower storage area and an audio-visual remote control device on the lower storage area in FIG. 3 with a closable accessory receptacle 44 being located on the lower shelf in both FIGS. 2 and 3. The accessory receptacle 44 being adapted for storing accessories which may need the additional protection of the closeable receptacle or other loose items which may move about the sectional storage unit if not contained. FIG. 3 illustrates the upper storage area 52 with a substantially planar deck 62 and an upper peripheral sidewall 60 encircling the base 32, the deck 62 supporting the base 32 with the upper sidewall 60.

The apparatus 20 may be made from a variety of materials and colors which complement the occupancy equipment 22, while the connecting structure 50 is detachable from the sectional storage unit 30 for easy cleaning. The lower peripheral sidewall 58 and the upper peripheral sidewall 60 are optionally adapted for receiving visual indicia or additional aesthetic features for enhancing the appeal of the organizing apparatus 20 such as paint, patterns or other visual features. The upper storage area 52 is connected to the lower storage area 54 with a first and second connecting leg 36 extending downwardly from the upper storage area 52. The first and second legs 36 are configured near the rear of the sectional storage unit 30, and illustrated as being integrated within the sectional storage unit 30 near the connecting structure 50. However, other alternatively configured connecting members may be provided for interconnecting the upper storage area 52 to the lower storage area 54 or for connecting additional vertically arranged storage areas to the sectional storage unit 30.

Figure 4:
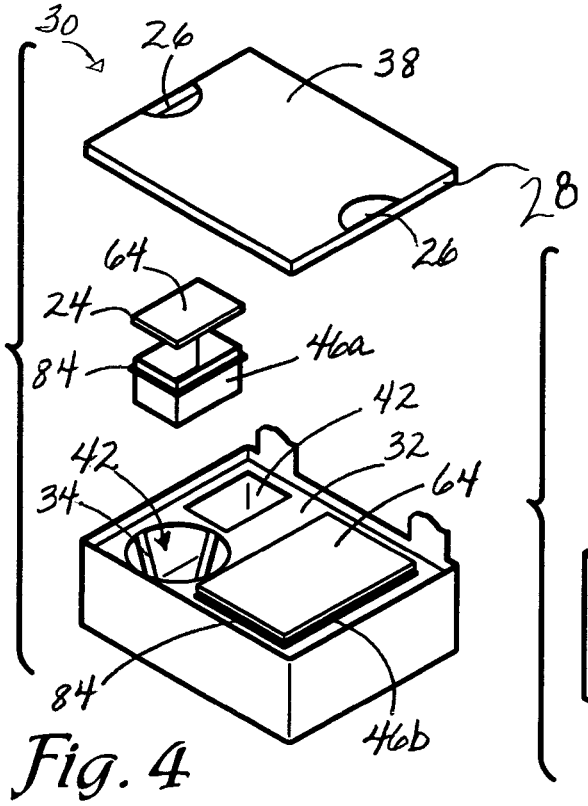
FIG. 4 is an exploded view of an alternative sectional storage unit configuration of the apparatus.
Figure 5:
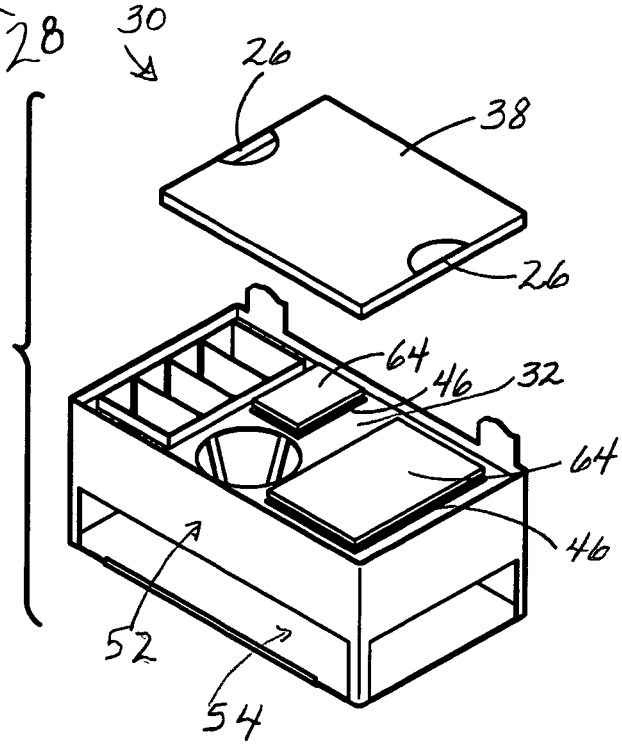
FIG. 5 is an exploded view of an alternative sectional storage unit configuration of the apparatus.
Figure 6:
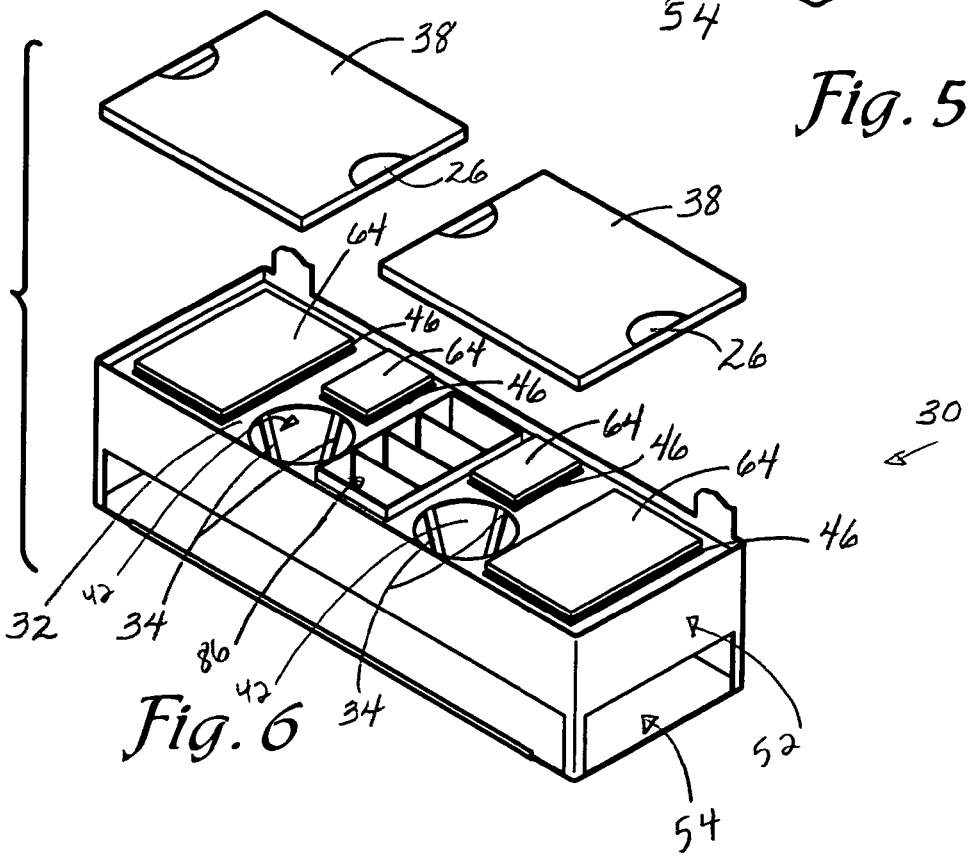
FIG. 6 is an exploded view of the alternative sectional storage unit configuration of the apparatus.

Alternative configurations of the sectional storage unit 30 are illustrated in FIGS. 4-6 with the sectional storage unit 30 including a base 32 having vessel holding compartments 42 receiving containers 46, 46*a* with a replaceable, resealable container lid 64 overlying the containers 46, 46*a*. In general, the illustrated container in FIG. 4 is defined by a top, a bottom and a side extending between the top and bottom providing an accessible container, having an optional lid 64 positioned externally to and opposite the bottom where the lid 64 has a downwardly extending lip 24 for at least partly overlying a side of the container 46*a* and adapted for limiting access to the container 46*a*. The container 46*a* with the resealable lid 64 helps to preserve the contents of the container 46*a,* allowing the unused portions to be remotely stored in a refrigerator or on a kitchen shelf during any period of nonuse or in the organizing apparatus 20 while the container 46*a* is received by the vessel holding compartment 42. A beveled ledge 84 optionally extends around the container 46*a* for projecting the container 46*a* outwardly from the base 32. Additionally, a vessel holding compartment 42 may be adapted to receive a beverage, eliminating the discomfort of handling a hot or cold container or the difficultly or inconvenience at stretching outwardly towards a table to retrieve the beverage.

The base is adapted with a receiving structure for receiving a base lid 38 having a periphery lip 28 encircling the lid 38 and separating it from the base 32. The receiving structure may include but is not limited to an upstanding lip encircling the base 32 and extending from it. The base lid 38 also includes a handle 26 for easily removal of the lid from the base. The base lid 38 helps protect the contents of any containers 44, 46, 46*a,* 48 received by the vessel holding compartments 42 of the base 32. The lid 38 while received by the base 32, adapts the base 32 to a writing surface, providing a table-like surface that provides a convenient area for placing a nearby item, wherein the apparatus 20 also provides a substantially planar, horizontal surface for writing.

FIGS. 4-6 also include supporting members 34 for aligning and supporting the containers 46, 46*a*. In general, the supporting members 34 align and support the containers 44, 46, 46*a*, 48 while received by the vessel holding compartments 42. As an illustration, the supporting members are fixed to the underside of the base 32 and are spatially arranged, the members 34 extending from one side of the vessel compartment 42 to the opposite side. Alternatively, the supporting members 34 could be perpendicularly arranged.

FIG. 5 illustrates the sectional storage unit with the upper and lower storage areas 52, 54, the upper area 52 having a slotted receiver section 86 for adjustably locating accessories, including several audio-visual accessories within the organizational apparatus. The slotted receiver section 86 includes plural pairs of opposing slots 88 adapted for slidably receiving vertical dividers 90 which span the slot pairs 88 forming a configurable compartmentalized slotted receiver section 86.

FIG. 6 illustrated the sectional storage area 30, with upper and lower areas 52, 54. The sectional storage unit 30 includes a dual base lid 38 configuration in which the base 32 receives two spaced apart base lids 38 for covering the vessel holding compartments 42. Providing access to any stored accessories, the base lids 38 are spaced apart at the slotted receiver section 86. The received base lids 38 also present a substantially planar horizontal surface for use with the sectional storage unit 30 while covering the containers 46. Accordingly, it may be appreciated that various sectional storage unit configuration may be accommodated.

Figure 7:
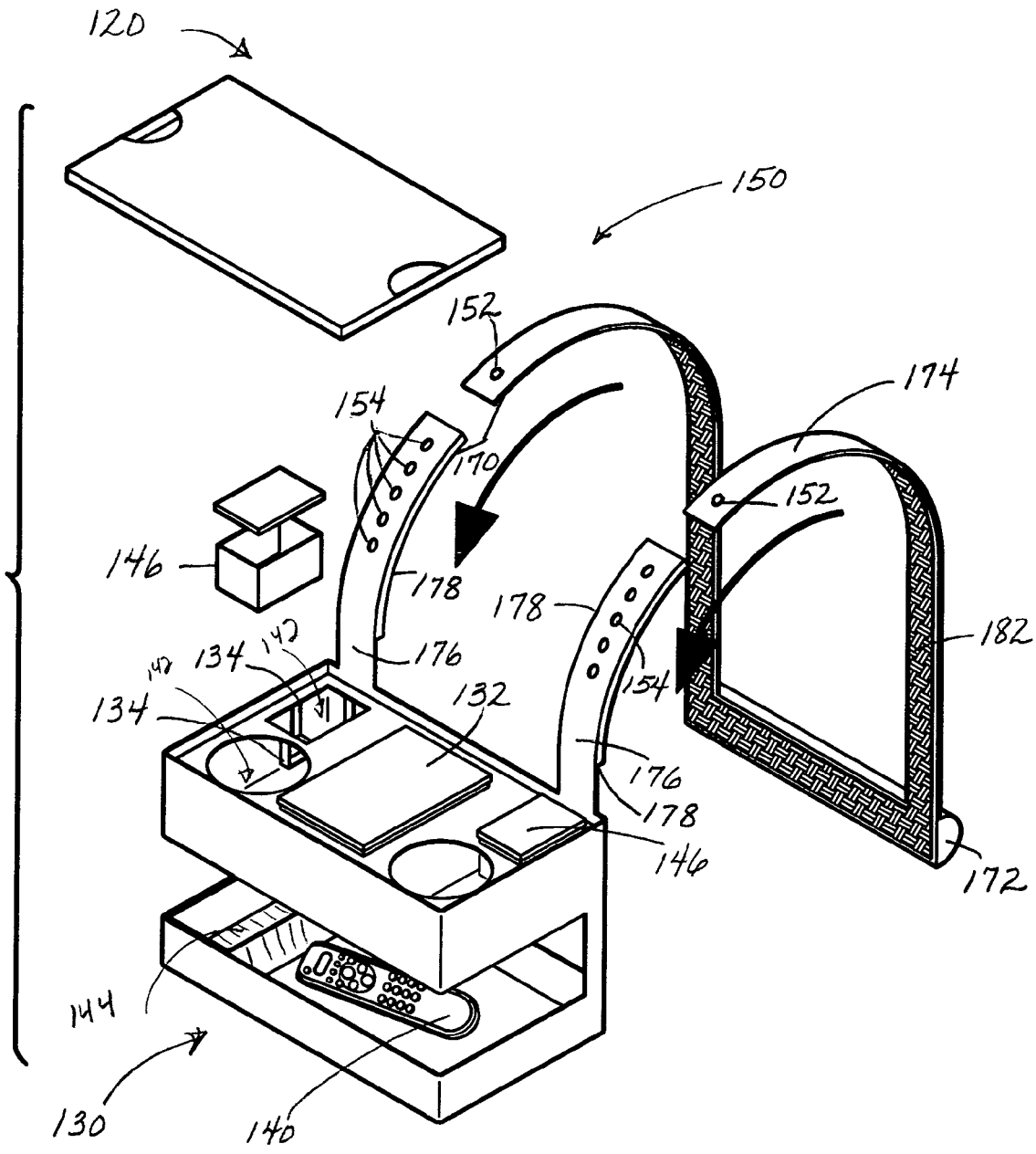
FIG. 7 is an exploded view of an alternative embodiment of the apparatus.

FIG. 7 illustrates an alternative embodiment of the apparatus 120 having connecting structure 150 which utilizes a push button 152 and a tab receiver 154 connecting structure 150 located on a curved arm structure 170 complementing the occupational equipment 122 (not shown) for receiving the adjustably connected sectional storage unit 130. In general, the connecting structure 150 is adapted for the features of the occupancy equipment 122 and for securely positioning the organizing apparatus 120 on the occupancy equipment 122. The curved arm structure 170 is adapted for positioning the apparatus 120 on the occupancy equipment 122 and includes a front channel 176 and a rear arcuate arm 174, the front channel 176 having a curvature complementary to the arcuate arm 174. The channel 176 has a pair of spaced apart receivers 178 being adapted for receiving the arcuate arm 174 which when received by the channel 176 spans the receivers 178.

The push button 152 retracts when under pressure and extends outwardly when the pressure is removed and is illustrated as being positioned in connection with the proximate end of the rear arm 174 of the connecting structure 150. The rear arm 174 also includes the distally positioned weighted member 172 located opposite the push button 152 and optional frictional surface 182 for frictionally securing the connection structure 150 to the occupancy equipment 122. The front channel 176 includes plural spaced apart tab receivers 154 for receiving the extending push button 152 as the rear arm 174 is received by the front arm channel 176. As the push button 152 is aligned with the tab receiver 154, the push button 152 extends outwardly from the tab receiver, engaging the tab receiver for positioning the rear arm 174 within the front channel 176 and adjustably securing the base 132 to the occupancy equipment 122. Alternatively, the push button 152 could be located in connection with the front channel 176 and the tab receivers 154 could be located in connection with the rear arm 174.

FIG. 7 also illustrates optional supporting members 134 located in a perpendicular arrangement in connection with the vessel holding compartment 142 for aligning and supporting various containers.

Figure 8:
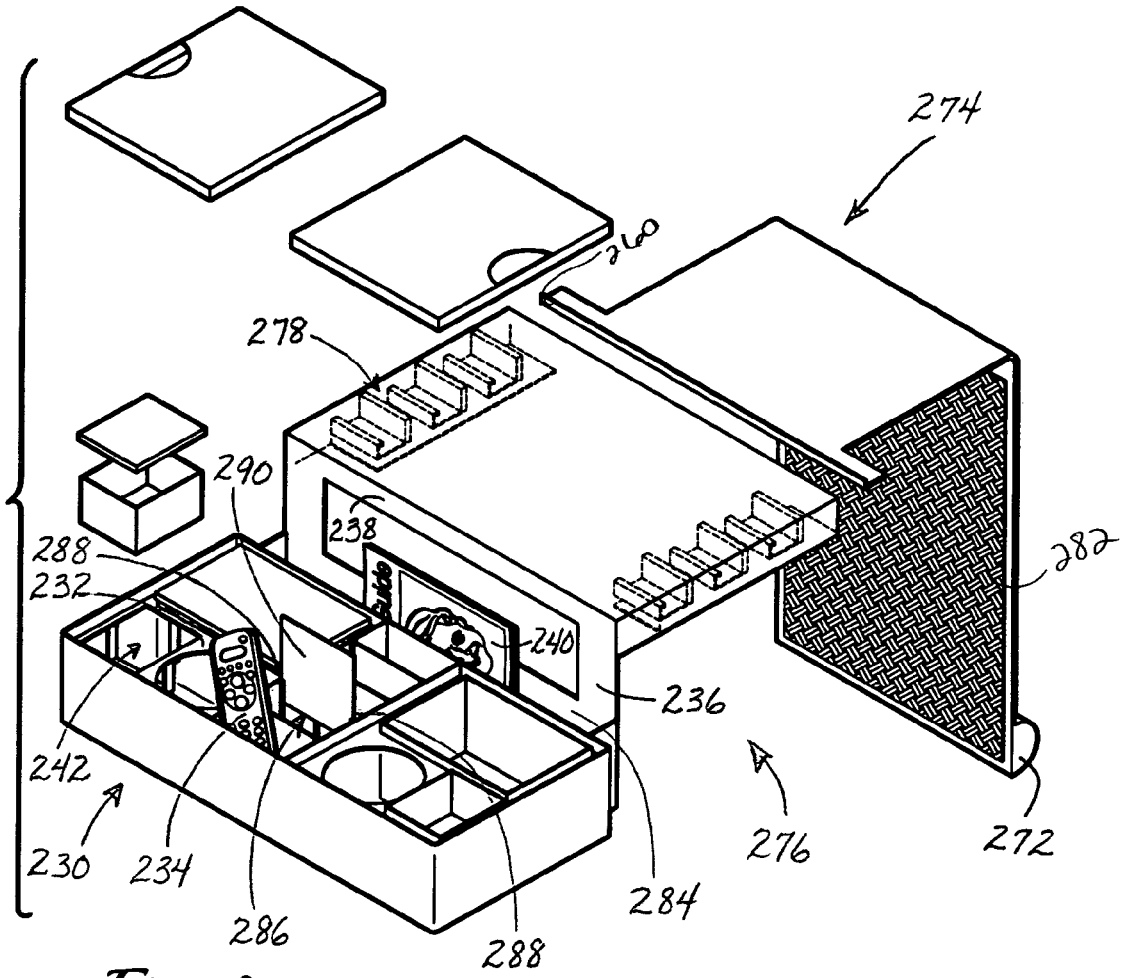
FIG. 8 is an exploded view of a third alternative embodiment of the apparatus.
Figure 9:
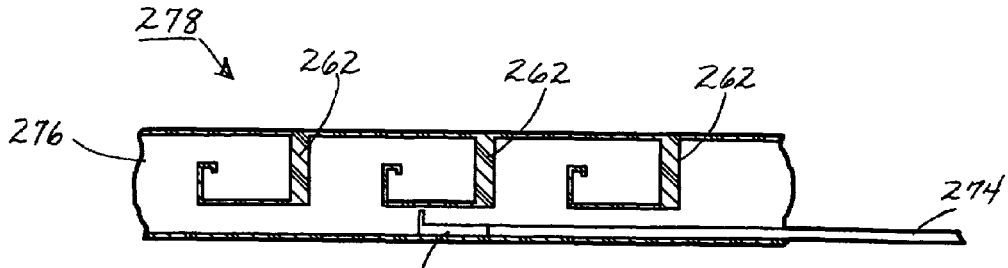
FIG. 9 is a detailed cut-away view of the assembly of the connecting structure illustrated in FIG. 8.

Another alternative connecting structure is illustrated in FIG. 8 with a rear offset section 274 adapted for an interconnection 278 between the rear offset section 274 and a front tray section 276 which includes a sectional storage unit 230. The rear offset section 274 presents a proximate upstanding lip 260, the rear offset section 274 angled downward and extending below the sectional storage unit 230, including a distally located weighted member 272 attached on the exterior of the rear section 274. In addition, the rear offset section 274 includes optional frictional surface 282 positioned opposite the weighted member 272 and between the rear section 274 and the occupancy equipment 222 (not shown).

The front section 276 is connected to the sectional storage unit 230 at a rear face 236 which has includes a gripable handle 238 located therein. The sectional storage unit 230 depicted in FIG. 8 has is adapted with a base 232 having vessel holding compartments 242 with optional support members 234 separated by a accessory holding compartment 286 which contains plural vertical slot pairs 288 adapted for receiving a vertical divider 290 spanning the slot pairs 288. The slots 288 are adapted for slidably receiving the divider 290, forming a configurable accessory holding compartment 286 for holding various accessories 234 including but not limited to audio-visual accessories. In addition, the sectional storage unit 230 includes a rear pocket 284 located between the rear face 236 and the base 232, the pocket 284 being adapted to store an audio-visual scheduling publication 240 therein.

Figure 10:
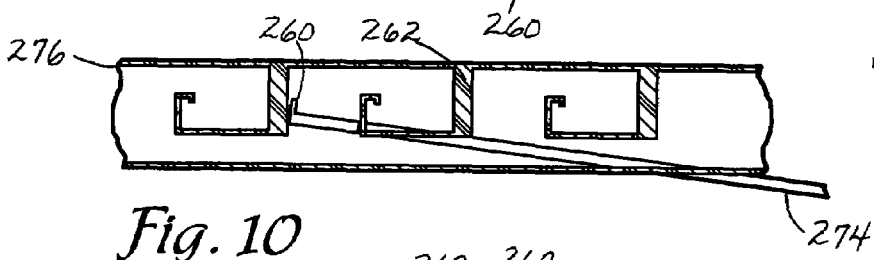
FIG. 10 is a detailed cut-away view of the assembly of the connecting structure illustrated in FIG. 8.
Figure 11:
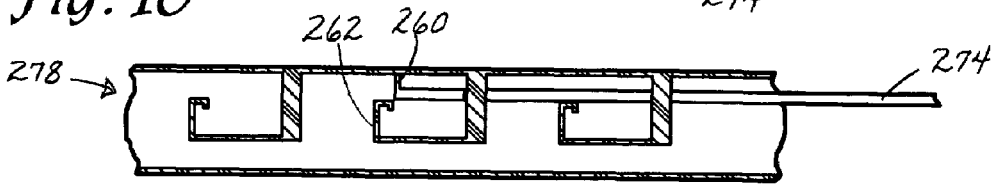
FIG. 11 is a detailed cut-away view of the assembly of the connecting structure illustrated in FIG. 8.
Figure 12:
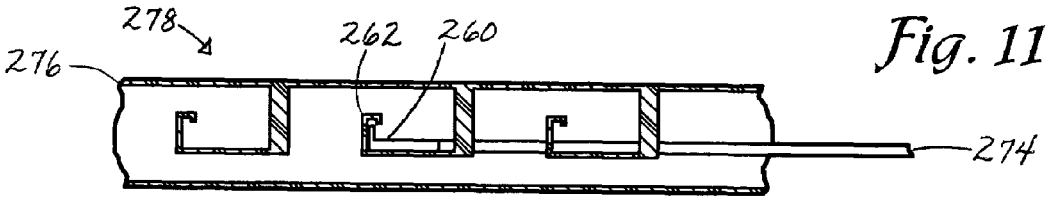
FIG. 12 is a detailed cut-away view of the assembly of the connecting structure illustrated in FIG. 8.

A cross-sectional view of the interconnection 278 is illustrated in FIGS. 9-12 showing the sequential view of the rear offset section 274 presenting the lip 260 being received by a plurality of lip receivers 262 presented by the front section 276. As the lip 260 is received in the front section 276, shown in FIG. 9, it passes at least one lip receiver 262 until the distance spanned by the front section 276 and the rear section 274 are compatible with the surface of the occupancy equipment 222 (not shown). Once the desired distance is obtained, the lip 260 pivots upward towards the top of the front section 276 as illustrated in FIG. 10. The rear section 274 then levels with the lip 260, and retracts backwardly from the lip receiver 262 as indicated in FIG. 11, to align the lip receiver 262 with the lip 260. After clearing the lip receiver 262, the rear section 274 then descends onto the lip receiver 262, engaging the lip receiver 262 with the lip 260, the interconnection 278 securing the front section 276 to the rear section 274 for securely supporting the sectional storage unit 230 on the occupancy equipment 222.

Figure 13:
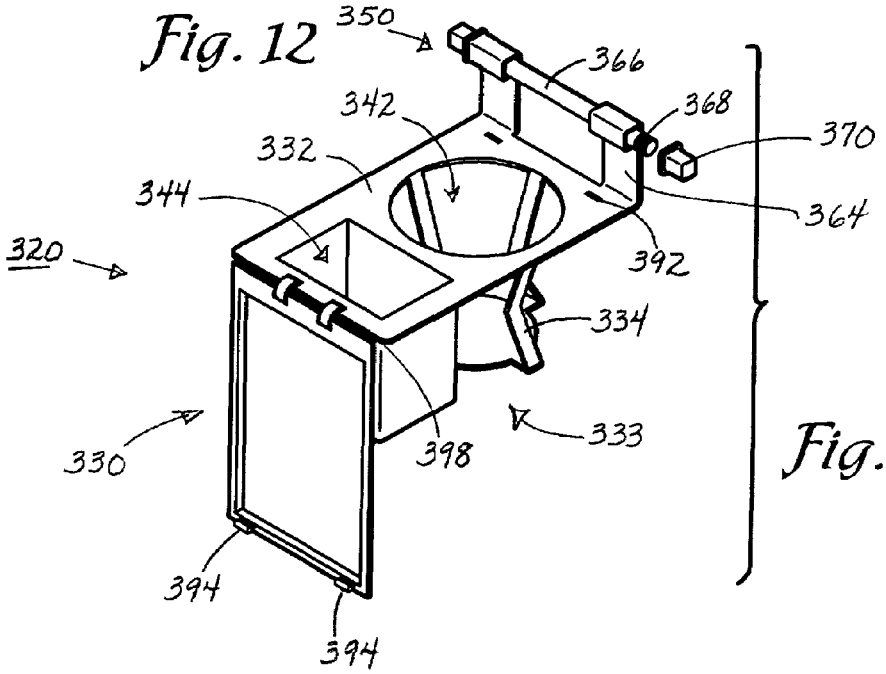
FIG. 13 is a front perspective of an alternative embodiment of the apparatus.

Another alternative embodiment of the organizing apparatus 330 is illustrated in FIG. 13 with a sectional storage unit 330 having a base 332 with a vessel holding compartment 342 having an inwardly biasing support member framework 333 having plural support members 334 attached to the base 332 and defining a bottom and a side. The base 332 also includes a holding compartment 344 adapted to hold various accessories as well as other containers such as but not limited to audio-visual remote controllers and food containers (not shown). The inwardly biased framework 333 provides a receiving structure to accommodate vessels having various dimensions and varying radii. Although, the vessel holding compartment 342 is illustrated as being circular; it may also be rectangular or irregular to accommodate various shaped containers. In addition, the organizing apparatus 330 includes a slit receiver 392 located near the rear of the base 332. The slit receiver is adapted for receiving a tab 394 located on a hinged lid 396 having hinge mechanism 398. In the closed configuration, the lid 396 is horizontally placed on the base 332, the tab 394 releasably received by the slit receiver 392. The closed configuration presents a horizontal working surface for use by an occupant of the occupancy equipment 322 (not shown). In the open configuration, the lid is rotated downwardly away from the base 332, providing unlimited access to the vessel holding compartments 342. The sectional storage unit optionally includes a brace pair 364 for securing the sectional storage unit 330 to a connecting structure 350 with the use of a horizontal member 366 spanning the brace pair 364, the horizontal member having optional threaded ends for receiving a threaded fastener 370.

It should be understood that while certain forms of this invention have been illustrated and described, it is not limited thereto except insofar as such limitations are included in the following claims.

The invention claimed is:

1. An organizing apparatus adapted for use with occupancy equipment, the apparatus comprising:

a sectional storage unit having a base with first and second vessel holding compartments, a connecting structure securing said unit to said equipment, said base having a front, a rear and a top portion extending therebetween, said top portion having a receiving structure adapted for receiving a replaceable lid, said first compartment being adapted for receiving a first container, said second compartment being adapted for receiving a second container, said base having receiving structure for an audio-visual aid, an offset section having a proximate end separated from a distal end, said proximate end including a lip extending outwardly from said proximate end, said distal end including a weighted member attached thereto, a front section having a plurality of lip receivers, said front section and said proximate end of said offset section forming an interconnection securing said front section to the rear section, and said lip engaging one of said lip receivers adjustably securing said storage unit on said occupancy equipment.

2. The apparatus as set forth in claim 1 wherein said second receiving structure is an upstanding lip encircling said top portion and extending therefrom.

3. The apparatus as set forth in claim 1 wherein said second receiving structure is a fastening mechanism with said lid having at least one connector releasably fastened to said top portion by said fastening mechanism.

4. The apparatus as set forth in claim 3 wherein said lid further includes a loop connector threaded through said lid and connected to said top portion in proximity to said front of said base for rotatably connecting said lid to said top portion.

* * * * *